US011741937B1

(12) United States Patent
Bastyr et al.

(10) Patent No.: US 11,741,937 B1
(45) Date of Patent: Aug. 29, 2023

(54) ACTIVE NOISE CANCELLATION SYSTEM SECONDARY PATH ADJUSTMENT

(71) Applicant: Harman International Industries, Incorporated, Stamford, CT (US)

(72) Inventors: Kevin J Bastyr, Franklin, MI (US); Riley Winton, Opelika, AL (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 17/683,873

(22) Filed: Mar. 1, 2022

(51) Int. Cl.
*G10K 11/178* (2006.01)

(52) U.S. Cl.
CPC ..... *G10K 11/17879* (2018.01); *G10K 2210/1282* (2013.01)

(58) Field of Classification Search
None
See application file for complete search history.

(56) References Cited

U.S. PATENT DOCUMENTS

2019/0270350 A1* 9/2019 Bastyr ..... G10K 11/1785
2021/0204043 A1 7/2021 Christoph et al.

FOREIGN PATENT DOCUMENTS

WO 2009081190 A1 7/2009
WO WO-2022263861 A1 * 12/2022 ..... A63F 13/215

OTHER PUBLICATIONS

Extended European Search Report of European patent application No. 23158921.9 dated Jun. 27, 2023, 9 pages.
Anonymous, "Fast resonance test", Research Disclosure, Kenneth Mason Publications, Hampshire, UK, GB, vol. 420, No. 2B, Apr. 1, 1999, XP007124149, ISSN: 0374-4353, 2 pages.

* cited by examiner

*Primary Examiner* — Kenny H Truong
(74) *Attorney, Agent, or Firm* — BROOKS KUSHMAN P.C.

(57) ABSTRACT

An active noise cancellation (ANC) system is provided with at least one loudspeaker to project an anti-noise sound within a room in response to receiving an anti-noise signal. A first controller is programmed to adjust a transfer function indicative of a secondary path between the at least one loudspeaker and at least one microphone within the room based on a resonance frequency of the at least one loudspeaker, and to generate the anti-noise signal based on the adjusted transfer function.

20 Claims, 7 Drawing Sheets

ACTIVE NOISE CANCELLATION SYSTEM SECONDARY PATH ADJUSTMENT

TECHNICAL FIELD

The present disclosure is directed to an active noise cancellation system and, more particularly, to adjusting a secondary path parameter to limit noise boosting and/or system instability.

BACKGROUND

Active Noise Cancellation (ANC) systems attenuate undesired noise using feedforward and/or feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, reduce the sound pressure level (SPL) at a location. In a vehicle cabin listening environment, potential sources of undesired noise come from the engine, the exhaust system, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibration generated from the tire and road interface that leads to unwanted audible road noise. This unwanted road noise inside the cabin is then cancelled, or reduced in level, by using loudspeakers to generate sound waves that are ideally opposite in phase and identical in magnitude to the noise to be reduced at one or more listeners' ears. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable engine noise inside the vehicle cabin. EOC systems use a non-acoustic sensor, such as an engine speed sensor, to generate a signal representative of the engine crankshaft rotational speed in revolutions-per-minute (RPM) as a reference. This reference signal is used to generate sound waves that are opposite in phase to the engine noise that is audible in the vehicle interior. Because EOC systems use a signal from an RPM sensor, they do not require vibration sensors.

RNC systems are typically designed to cancel broadband signals, while EOC systems are designed and optimized to cancel narrowband signals, such as individual engine orders. ANC systems within a vehicle may provide both RNC and EOC technologies. Such vehicle-based ANC systems are typically Least Mean Square (LMS) adaptive feed-forward systems that continuously adapt W-filters based on noise inputs (e.g., acceleration inputs from the vibration sensors in an RNC system) and signals of physical microphones located in various positions inside the vehicle's cabin. A feature of LMS-based feed-forward ANC systems and corresponding algorithms, such as the filtered-X LMS (FxLMS) algorithm, is the storage of the impulse response, or secondary path, between each physical microphone and each anti-noise loudspeaker in the system. The secondary path is the transfer function between an anti-noise generating loudspeaker and a physical microphone, essentially characterizing how an electrical anti-noise signal becomes sound that is radiated from the loudspeaker, travels through a vehicle cabin to a physical microphone, and becomes the microphone output signal.

The remote or virtual microphone technique is a technique in which an ANC system estimates an error signal generated by an imaginary or remote microphone at a location where no real physical microphone is located, based on the error signals received from one or more real physical microphones. This remote microphone technique can improve noise cancellation at a listener's ears even when no physical microphone is actually located there.

ANC systems employ modeled transfer characteristics, which estimate the various secondary paths, to adapt the W-filters. Noise cancellation performance degradation, noise gain, or actual instability can result if the modeled transfer characteristic of the secondary path stored in the ANC system differs from the actual secondary path within the vehicle. The actual secondary path may deviate from the stored secondary path model, typically measured on a "golden system" by trained engineers, when a vehicle becomes substantially different from the reference vehicle or system in terms of geometry, passenger count, luggage loading, or the like. Other differences could include loudspeaker or microphone unit-to-unit variation, aging or failure, microphone or speaker blocking, non-identical loudspeaker replacement or wiring errors. Another source of secondary path mismatch is due to the tolerance, e.g., up to approximately 15%, in the speaker's resonance frequency due to typical manufacturing processes and material property variation of suspension materials. This speaker resonance frequency range results in a smaller margin of safety to undesirable noise boosting and divergence in both EOC and RNC systems. Further, the speaker resonance frequency is temperature dependent, which may result in the resonance frequency of a speaker varying over time.

SUMMARY

In one embodiment, an active noise cancellation (ANC) system is provided with at least one loudspeaker to project an anti-noise sound within a room in response to receiving an anti-noise signal. A first controller is programmed to adjust a transfer function indicative of a secondary path between the at least one loudspeaker and at least one microphone within the room based on a resonance frequency of the at least one loudspeaker, and to generate the anti-noise signal based on the adjusted transfer function.

In another embodiment, a method is provided for controlling stability in an active noise cancellation (ANC) system. A transfer function indicative of a secondary path between the loudspeaker and a microphone within a passenger cabin is adjusted based on a resonance frequency of the loudspeaker. An anti-noise signal, to be radiated from a loudspeaker within a passenger cabin as an anti-noise sound, is generated based on the adjusted transfer function.

In yet another embodiment, an active noise cancellation (ANC) system is provided with at least one loudspeaker to project an anti-noise sound within a passenger cabin of a vehicle in response to receiving an anti-noise signal. A microphone provides an error signal indicative of noise and the anti-noise sound within the passenger cabin. A sensor measures a voltage and a current supplied to the loudspeaker. At least one controller is programmed to: determine a resonance frequency of the loudspeaker based on the voltage and current supplied to the loudspeaker, adjust a transfer function indicative of a secondary path between the loudspeaker and the microphone based on the resonance frequency based on the resonance frequency, and generate the anti-noise signal based on the adjusted transfer function.

As such, the ANC system directly measures the resonance frequency of a loudspeaker in real time and updates the stored secondary path in real time to improve noise cancellation system performance and prevent undesirable noise boosting and divergence in both EOC and RNC systems.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis.

Figure 1:
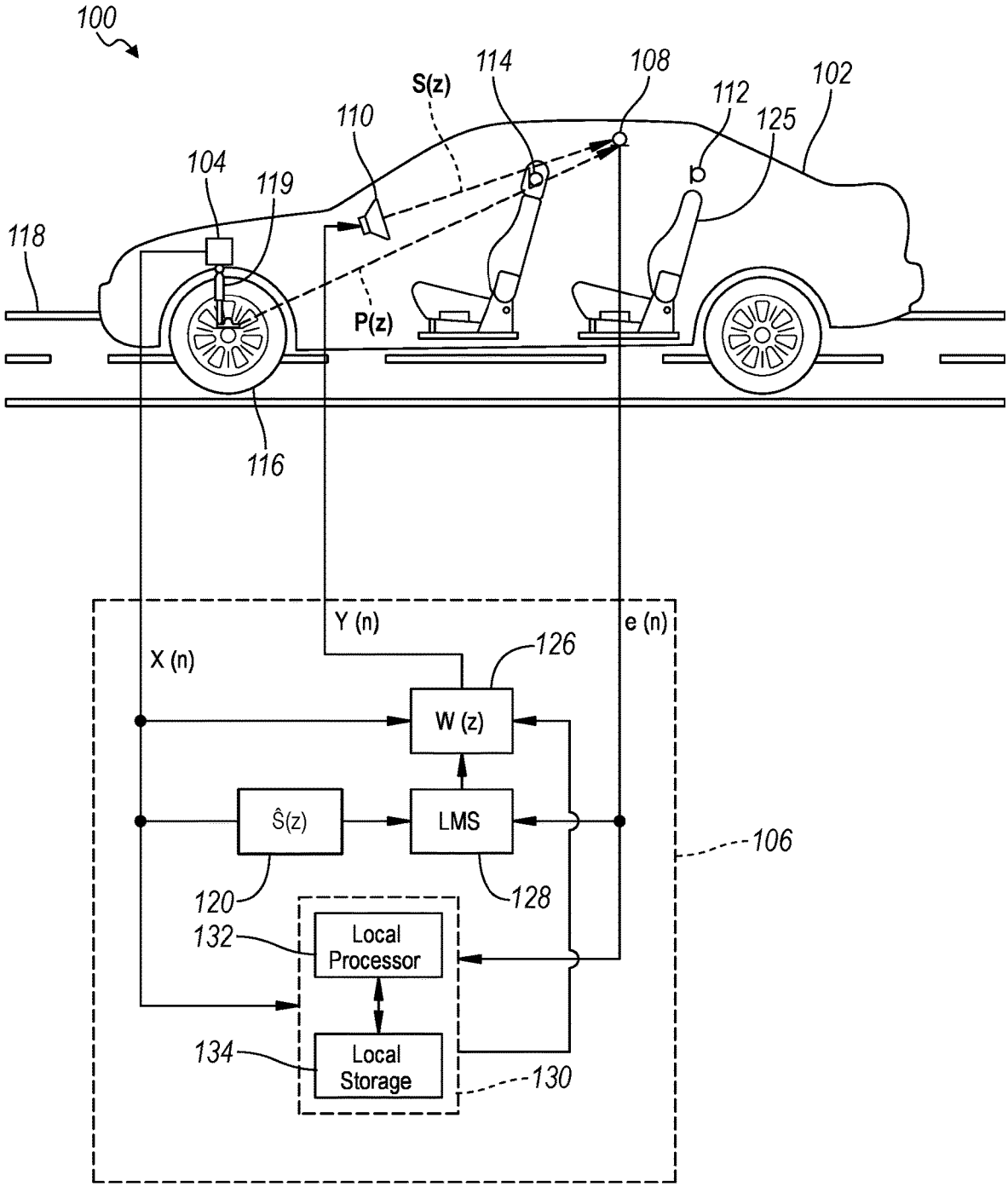
FIG. 1 is a schematic diagram of a vehicle having an active noise cancellation (ANC) system including a road noise cancellation (RNC) and a remote microphone, in accordance with one or more embodiments.

With reference to FIG. 1, a road noise cancellation (RNC) system is illustrated in accordance with one or more embodiments and generally represented by numeral 100. The RNC system 100 is depicted within a vehicle 102 having one or more vibration sensors 104. The vibration sensors 104 are disposed throughout the vehicle 102 to monitor the vibratory behavior of the vehicle's suspension, subframe, as well as other axle and chassis components. The RNC system 100 may be integrated with a broadband adaptive feed-forward active noise cancellation (ANC) system 106 that generates anti-noise by adaptively filtering the signals from the vibration sensors 104 using one or more physical microphones 108. The anti-noise signal may then be played through one or more loudspeakers 110 to become sound within a room, such as a passenger cabin of the vehicle 102. S(z) represents a transfer function between a single loudspeaker 110 and a single microphone 108. The ANC system 106 evaluates measured signals to determine the resonance frequency of each loudspeaker 110, and adaptively adjusts a secondary path parameter based on the resonance frequency to limit or eliminate noise boosting in the affected frequency ranges.

While FIG. 1 shows a single vibration sensor 104, microphone 108, and loudspeaker 110 for simplicity purposes only, it should be noted that typical RNC systems use multiple vibration sensors 104 (e.g., ten or more), microphones 108 (e.g., four to six), and loudspeakers 110 (e.g., four to eight). The ANC system 106 may also include one or more remote microphones 112, 114 that are used for adapting anti-noise signal(s) that are optimized for the occupants in the vehicle 102, according to one or more embodiments.

The vibration sensors 104 may include, but are not limited to, accelerometers, force gauges, geophones, linear variable differential transformers, strain gauges, and load cells. Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibration sensed in their X-direction, Y-direction and Z-direction. Single-axis and multi-axis accelerometers, therefore, may be used as vibration sensors 104 to detect the magnitude and phase of acceleration and may also be used to sense orientation, motion, and vibration.

Noise and vibration that originates from a wheel 116 moving on a road surface 118 may be sensed by one or more of the vibration sensors 104 mechanically coupled to a suspension device 119 or a chassis component of the vehicle 102. The vibration sensor 104 may output a noise signal X(n), which is a vibration signal that represents the detected road-induced vibration. It should be noted that multiple vibration sensors are possible, and their signals may be used separately, or may be combined. In certain embodiments, a microphone may be used in place of a vibration sensor to output the noise signal X(n) indicative of noise generated from the interaction of the wheel 116 and the road surface 118. The noise signal X(n) may be filtered with a modeled transfer characteristic $\hat{S}(z)$, which estimates the secondary path (i.e., the transfer function between an anti-noise loudspeaker 110 and a physical microphone 108), by a secondary path filter 120.

Road noise that originates from the interaction of the wheel 116 and the road surface 118 is also transferred, mechanically and/or acoustically, into the passenger cabin and is received by the one or more microphones 108 inside the vehicle 102. The one or more microphones 108 may, for example, be located in a headliner of the vehicle 102, or in some other suitable location to sense the acoustic noise field heard by occupants inside the vehicle 102, such as an occupant sitting on a rear seat 125. The road noise originating from the interaction of the road surface 118 and the wheel 116 is transferred to the microphone 108 according to a transfer characteristic P(z), which represents the primary path (i.e., the transfer function between an actual noise source and a physical microphone).

The microphone 108 may output an error signal e(n) representing the sound present in the cabin of the vehicle 102 as detected by the microphone 108, including noise and anti-noise. In the RNC system 100, an adaptive transfer characteristic W(z) of a controllable filter 126 may be controlled by adaptive filter controller 128, which may operate according to a known least mean square (LMS) algorithm based on the error signal e(n) and the noise signal X(n) filtered with the modeled transfer characteristic $\hat{S}(z)$ by the secondary path filter 120. The controllable filter 126 is often referred to as a W-filter. An anti-noise signal Y(n) may be generated by the controllable filter or filters 126 and the vibration signal, or a combination of vibration signals X(n). The anti-noise signal Y(n) ideally has a waveform such that when played through the loudspeaker 110, anti-noise is generated near the occupants' ears and the microphone 108, that is substantially opposite in phase and identical in magnitude to that of the road noise audible to the occupants of the vehicle cabin. The anti-noise from the loudspeaker 110 may combine with road noise in the vehicle cabin near the microphone 108 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, at least one controller 130 (hereafter "the controller 130") may collect and process the data from the vibration sensors 104 and the microphones 108. The controller 130 includes a processor 132 and storage 134. The processor 132 collects and processes the data to construct a database or map containing data and/or parameters to be used by the vehicle 102. The data collected may be stored locally in the storage 134, or in the cloud, for future use by the vehicle 102. Examples of the types of data related to the RNC system 100 that may be useful to store locally at storage 134 include, but are not limited to, accelerometer or microphone spectra or time dependent signals, secondary paths corresponding to different driver resonance frequencies, and the magnitude and phase characteristics of driver resonances with different quality factors.

Although the controller 130 is shown as a single controller, it may contain multiple controllers, or it may be embodied as software code within one or more other controllers, such as the adaptive filter controller 128. The controller 130 generally includes any number of microprocessors, ASICs, ICs, memory (e.g., FLASH, ROM, RAM, EPROM and/or EEPROM) and software code to co-act with one another to perform a series of operations. Such hardware and/or software may be grouped together in modules to perform certain functions. Any one or more of the controllers or devices described herein include computer executable instructions that may be compiled or interpreted from computer programs created using a variety of programming languages and/or technologies. In general, a processor, e.g., the processor 132 receives instructions, for example from a memory, e.g., the storage 134, a computer-readable medium, or the like, and executes the instructions. A processing unit is a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The controller 130 also includes predetermined data, or "look up tables" that are stored within the memory, according to one or more embodiments.

As previously described, typical RNC systems may use several vibration sensors, microphones and loudspeakers to sense structure-borne vibratory behavior of a vehicle and generate anti-noise. The vibration sensors may be multi-axis accelerometers having multiple output channels. For instance, triaxial accelerometers typically have a separate electrical output for vibrations sensed in their X-direction, Y-direction, and Z-direction. A typical configuration for an RNC system may have, for example, six error microphones, six loudspeakers, and twelve channels of acceleration signals coming from four triaxial accelerometers or six dual-axis accelerometers. Therefore, the RNC system will also include multiple S'(z) filters (e.g., secondary path filters 120) and multiple W(z) filters (e.g., controllable filters 126).

The simplified RNC system schematic depicted in FIG. 1 shows one secondary path, represented by S(z), between the loudspeaker 110 and the microphone 108. As previously mentioned, RNC systems typically have multiple loudspeakers, microphones and vibration sensors. Accordingly, a six-speaker, six-microphone RNC system will have thirty-six total secondary paths (i.e., 6×6). Correspondingly, the six-speaker, six-microphone RNC system may likewise have thirty-six $\hat{S}(z)$ filters (i.e., secondary path filters 120), which estimate the transfer function for each secondary path. As shown in FIG. 1, an RNC system will also have one W(z) filter (i.e., controllable filter 126) between each noise signal X(n) from a vibration sensor (i.e., accelerometer) 104 and each loudspeaker 110. Accordingly, a twelve-accelerometer signal, six-speaker RNC system may have seventy-two W(z) filters. The relationship between the number of accelerometer signals, loudspeakers, and W(z) filters is illustrated in FIG. 2.

Figure 2:
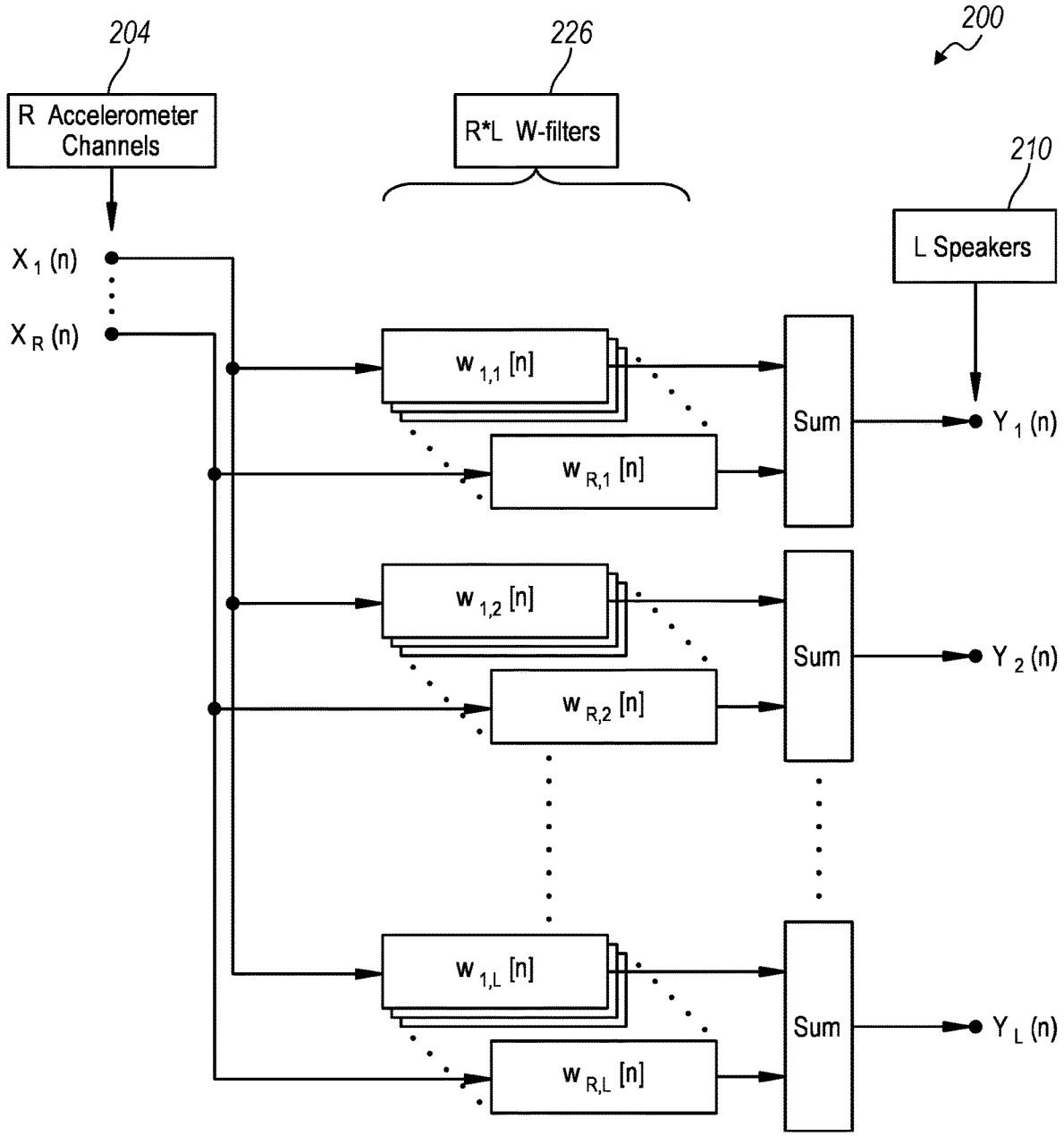
FIG. 2 is a sample schematic diagram demonstrating relevant portions of an RNC system scaled to include R accelerometer signals and L loudspeaker signals.

FIG. 2 is a sample schematic diagram demonstrating relevant portions of an RNC system 200 scaled to include R accelerometer signals $[X_1(n), X_2(n), \ldots X_R(n)]$ from accelerometers 204 and L loudspeaker signals $[Y_1(n), Y_2(n), \ldots Y_L(n)]$ from loudspeakers 210. Accordingly, the RNC system 200 may include R*L controllable filters (or W-filters) 226 between each of the accelerometer signals and each of the loudspeakers. As an example, an RNC system having twelve accelerometer outputs (i.e., R=12) may employ six dual-axis accelerometers or four triaxial accelerometers. In the same example, a vehicle having six loudspeakers (i.e., L=6) for reproducing anti-noise, therefore, may use seventy-two W-filters in total. At each of the L loudspeakers, R W-filter outputs are summed to produce the loudspeaker's anti-noise signal Y(n). Each of the L loudspeakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a loudspeaker.

The ANC system 106 illustrated in FIG. 1 may also include an engine order cancellation (EOC) system. As mentioned above, EOC technology uses a non-acoustic signal such as an engine speed signal representative of the engine crankshaft rotational speed as a reference in order to generate sound that is opposite in phase to the engine noise audible in the vehicle interior. EOC systems may utilize a narrowband feed-forward ANC framework to generate anti-noise using an engine speed signal to guide the generation of an engine order signal identical in frequency to the engine order to be cancelled, and adaptively filtering it to create an anti-noise signal. After being transmitted via a secondary path from an anti-noise source to a listening position or physical microphone, the anti-noise ideally has the same amplitude, but opposite phase, as the combined sound generated by the engine and exhaust pipes after being filtered by the primary paths that extend from the engine to the listening position and from the exhaust pipe outlet to the listening position or physical or remote microphone position. Thus, at the place where a physical microphone resides in the vehicle cabin (i.e., most likely at or close to the listening position), the superposition of engine order noise and anti-noise would ideally become zero so that acoustic error signal received by the physical microphone would only record sound other than the (ideally cancelled) engine order or orders generated by the engine and exhaust.

Commonly, a non-acoustic sensor, for example an engine speed sensor, is used as a reference. Engine speed sensors may be, for example, Hall Effect sensors which are placed adjacent to a spinning steel disk. Other detection principles can be employed, such as optical sensors or inductive sensors. The signal from the engine speed sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Figure 3:
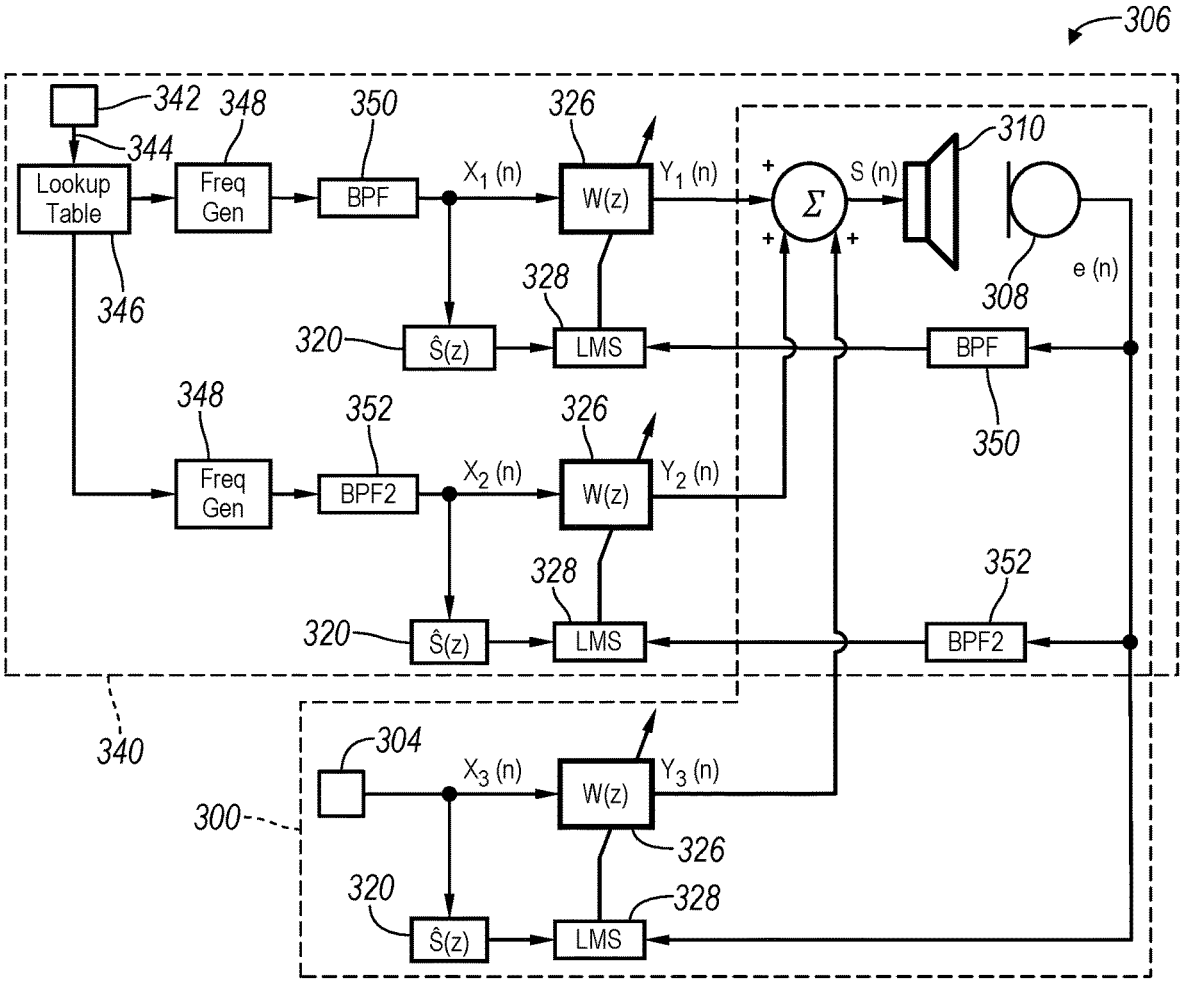
FIG. 3 is a sample schematic block diagram of an ANC system including an engine order cancellation (EOC) system and an RNC system.

FIG. 3 is a schematic block diagram illustrating an example of an ANC system 306, including both an RNC system 300 and an EOC system 340. Similar to RNC system 100, the RNC system 300 may include a vibration sensor 304, a physical microphone 308, a loudspeaker 310, a secondary path filter 320, a w-filter 326, and an adaptive filter controller 328, consistent with operation of the vibration sensor 104, the physical microphone 108, the loudspeaker 110, the secondary path filter 120, the w-filter 126, and the adaptive filter controller 128, respectively, discussed above.

The EOC system 340 may include an engine speed sensor 342 to provide an engine speed signal 344 (e.g., a square-wave signal) indicative of rotation of an engine crank shaft or other rotating shaft such as the drive shaft, half shafts or other shafts whose rotational rate is aligned with vibrations coupled to vehicle components that lead to noise in the passenger cabin. In some embodiments, the engine speed signal 344 may be obtained from a vehicle network bus (not shown). As the radiated engine orders are directly proportional to the crank shaft RPM, the engine speed signal 344 is representative of the frequencies produced by the engine and exhaust system. Thus, the signal from the engine speed sensor 342 may be used to generate reference engine order signals corresponding to each of the engine orders for the vehicle. Accordingly, the engine speed signal 344 may be used in conjunction with a lookup table 346 of Engine Speed (RPM) vs. Engine Order Frequency, which provides a list of engine orders radiated at each engine speed. The frequency generator 348 may take as an input the Engine Speed (RPM) and generate a sine wave for each order based on this lookup table 346.

The frequency of a given engine order at the sensed Engine Speed (RPM), as retrieved from the lookup table 346, may be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 may be sent to an adaptive controllable filter 326, or W-filter, which provides a corresponding anti-noise signal Y(n) to the loudspeaker 310. As shown, various components of this narrow-band, EOC system 340 may be identical to the broadband RNC system 300, including the physical microphone 308, adaptive filter controller 328 and secondary path filter 320. The anti-noise signal Y(n), broadcast by the loudspeaker 310 generates anti-noise that is substantially out of phase but identical in magnitude to the actual engine order noise at the location of a listener's ear, which may be in close proximity to a physical microphone 308, thereby reducing the sound amplitude of the engine order. Because engine order noise is narrow band, the error signal e(n) may be filtered by a bandpass filter 350 prior to passing into the LMS-based adaptive filter controller 328. In an embodiment, proper operation of the LMS adaptive filter controller 328 is achieved when the noise signal X(n) output by the frequency generator 348 is bandpass filtered using the same bandpass filter parameters.

In order to simultaneously reduce the amplitude of multiple engine orders, the EOC system 340 may include multiple frequency generators 348 for generating a noise signal X(n) for each engine order based on the Engine Speed (RPM) signal 344. As an example, FIG. 3 shows a two order EOC system having two such frequency generators for generating a unique noise signal (e.g., $X_1(n)$, $X_2(n)$, etc.) for each engine order based on engine speed. Because the frequency of the two engine orders differ, the bandpass filters 350, 352 (labeled BPF and BPF2) have different high- and low-pass filter corner frequencies. The number of frequency generators and corresponding noise-cancellation components will vary based on the number of engine orders to be cancelled for a particular engine of the vehicle. As the two-order EOC system 340 is combined with the RNC system 300 to form the ANC system 306, the anti-noise signals Y(n) output from the three controllable filters 326 are summed and sent to the loudspeaker 310 as a loudspeaker signal S(n). Similarly, the error signal e(n) from the physical microphone 308 may be sent to the three LMS adaptive filter controllers 328.

Noise cancellation performance degradation, noise gain, or actual instability may result if the modeled transfer characteristic $\hat{S}(z)$, representing an estimate of the secondary path, that is stored in the ANC system does not match the actual secondary path S(z) of the system. As previously discussed, the secondary path is the transfer function between an anti-noise generating loudspeaker and a physical microphone. Accordingly, it essentially characterizes how the electrical anti-noise signal Y(n) becomes sound that is radiated from the loudspeaker, travels through the car cabin to the physical microphone, and becomes part of the microphone output or error signal e(n) in the ANC system. The actual secondary path S(z) may deviate from the stored secondary path model $\hat{S}(z)$, which is typically measured on a "golden system" by trained engineers, when a vehicle configuration or audio system component (e.g., a loudspeaker, amplifier, or microphone) become substantially different from the reference vehicle configuration or audio system component in terms of performance, geometry, passenger count, luggage loading, or the like.

Filtered-X LMS (FxLMS) ANC systems typically include a set of predetermined secondary paths from a "golden sample vehicle," or "typical vehicle" stored in the amplifier of each vehicle that is manufactured and sold. The set of secondary paths are used to filter the reference, or "X" signals, hence the term filtered-X LMS. The secondary path characterizes how anti-noise is transmitted from each loudspeaker to each error microphone in the system, so an 8 loudspeaker, 8 microphone system has 64 stored secondary paths. Undesirable noise boosting and system instability can occur in a particular vehicle if any of the 64 stored "golden sample" secondary paths does not sufficiently match that vehicle's individual secondary path. The secondary path depends on the exact sensitivity and frequency dependent characteristics of each of the loudspeakers and microphones as well as the acoustic resonance frequencies of the vehicle cabin that are excited by the loudspeakers and sensed by the microphones. While tolerances on microphone performance characteristics can be very tight (+/−1% in sensitivity), the tolerances in the low frequency behavior of the loudspeakers are less controlled, with +/−15% being a typical uncertainty in the loudspeaker's resonance frequency, due to typical manufacturing processes (e.g. variation inherent in the mass of glue applied during loudspeaker assembly) and typical variation in material properties in the suspension components (e.g. the spider) of loudspeakers. Further, the loudspeaker resonance frequency is temperature dependent, due to the temperature dependent stiffness in the loudspeaker suspension materials. This range in loudspeaker resonance frequency creates an undesirable frequency dependent magnitude and phase difference between the stored "golden sample" secondary path and the actual secondary path, which leads directly to a smaller margin of safety to undesirable noise boosting and divergence in both EOC and RNC systems.

Figure 4:
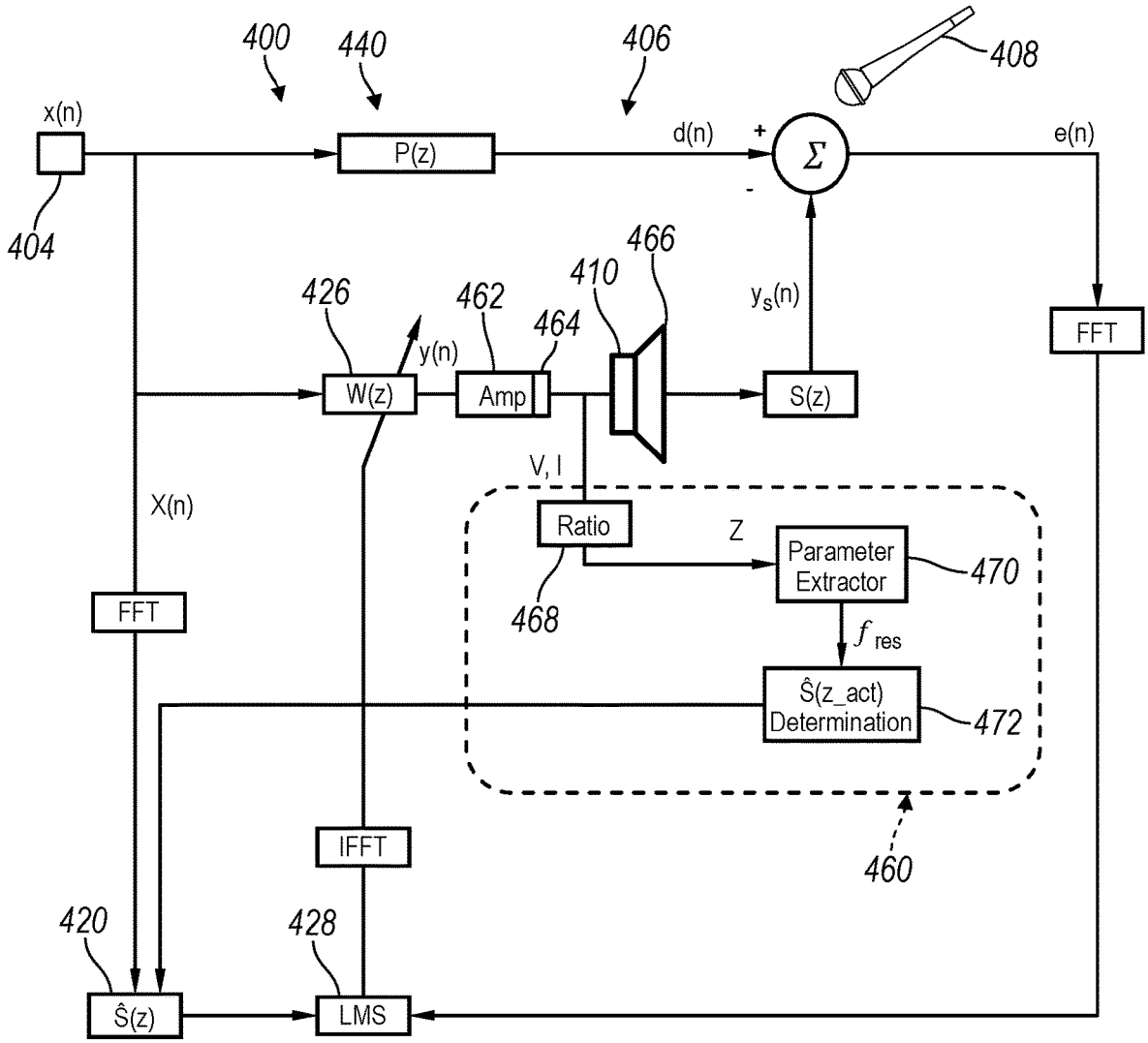
FIG. 4 is a schematic block diagram representing an ANC system including an additional signal processing block to adjust a secondary path parameter, in accordance with one or more embodiments of the present disclosure.

FIG. 4 is a schematic block diagram of a vehicle-based ANC system 406 showing many of the key ANC system parameters that may be used to adapt or adjust w-filter parameters, based on driver resonance frequency, in order to improve noise cancellation or limit or eliminate noise boosting in the affected frequency ranges. For ease of explanation, the ANC system 406 illustrated in FIG. 4 is shown with components and features of an RNC system 400 and an EOC system 440. Accordingly, the ANC system 406 is a schematic representation of an RNC and/or EOC system, such as those described in connection with FIGS. 1-3, featuring additional system components of the ANC system 406 including an additional signal processing block 460. Similar components may be numbered using a similar convention.

For instance, similar to the ANC system 106, the ANC system 406 may include an accelerometer or vibration sensor 404, a physical microphone 408, a loudspeaker 410, a secondary path filter 420, a w-filter 426, and an adaptive filter controller 428, consistent with operation of the vibration sensor 104, the physical microphone 108, the loudspeaker 110, the secondary path filter 120, the w-filter 126, and the adaptive filter controller 128, respectively, discussed above. FIG. 4 also shows the primary path P(z), the secondary path S(z), fast Fourier transform (FFT) blocks for converting signals to the frequency domain, and an inverse FFT (IFFT) block for converting signals to the time domain, in block form for illustrative purposes. The secondary path filter 420 includes a transfer characteristic of the secondary path S(z) that is based on predetermined data. The ANC system 406 adjusts the transfer characteristic of secondary path S(z) based on the resonance frequency of the loudspeaker 410.

The ANC system 406 determines the resonance frequency ($f_{res}$) of the loudspeaker 410 in signal processing block 460. The ANC system 406 includes an amplifier 462 with a controller 464 that monitors characteristics of the electrical signal supplied to the loudspeaker 410. The controller 464 may be mounted within a housing 466 of the loudspeaker 410, or external to the housing 466, or any other location. The controller 464 provides a voltage signal (V) and a current signal (I) based on characteristics of the monitored electrical signal supplied to the loudspeaker 410. In one embodiment, the controller 464 includes a current sensing resistor (not shown) for generating a real time signal representing the current, in addition to the real time voltage signal. The controller 464 includes a processor, memory, and a transceiver (not shown), according to one or more embodiments. In one or more embodiments, the controller 464 includes a digital to analog converter (DAC) for providing the time dependent V and I signals to signal processing block 460.

The ANC system 406 determines an electrical impedance (Z) based on a ratio of V and I (Z=V/I) at block 468. At block 470, the ANC system 406 determines the resonance frequency ($f_{res}$) of the loudspeaker 410 based on the electrical impedance (Z). In one embodiment, the ANC system 406 determines $f_{res}$ based on Z using a simple peak finding technique, wherein the frequency of maximum impedance over the whole frequency band, or over the band of interest (20 Hz to 200 Hz) for midsize to large woofers, represents the resonance frequency.

In another embodiment, the ANC system 406 determines $f_{res}$ based on the frequency dependent current supplied to the loudspeaker 410, wherein the frequency of minimum current over the whole frequency band, or over the band of interest (20 Hz to 200 Hz) for midsize to large woofers, represents the resonance frequency. The ANC system 406 may average the V and I signals over time, e.g., 0.5 to approximately 2 seconds, to produce a high-quality estimate of the driver resonance frequency, as not all the frequencies in the band of interest will be present at every instant in time. Additionally, the V and I signals include the anti-noise sent to the loudspeakers, plus any additional signals, such as the music signals. In other embodiments, the ANC system 406 determines $f_{res}$ based on a signal input from a smart amplifier that is external to the ANC system 406 (not shown). In other embodiments, the ANC system 406 may determine the resonance frequency based on signals representing the loudspeaker position, velocity, acceleration, and/or internal box pressure using the lumped element Thiele-Small loudspeaker theory. In an embodiment, the loudspeakers 410 are measured, and data representing the resonance frequency of the loudspeakers 410 is acquired at the time that the music playback and noise cancellation systems are installed in the vehicle 102, and these resonance frequencies or data are stored as predetermined data in a lookup table for later use by the ANC system 406.

At block 472, the ANC system 406 determines the actual transfer characteristic of the secondary path $\hat{S}$(z_act) based on the resonance frequency ($f_{res}$) of the loudspeaker 410. Then the ANC system 406 adjusts a secondary path parameter of the secondary path filter 420 to replace the estimated transfer characteristic of the secondary path $\hat{S}$(z) with the actual transfer characteristic of the secondary path $\hat{S}$(z_act). Then the adaptive filter controller 428 controls the w-filter 426 adaptation based on the adjusted secondary path parameter.

Figure 5:
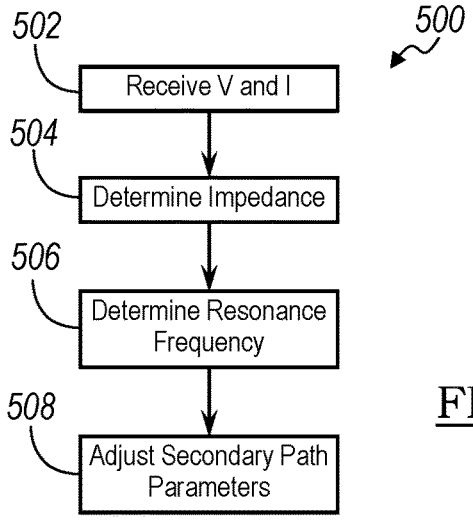
FIG. 5 is a flowchart depicting a method for adjusting the secondary path parameter in an ANC system, in accordance with one or more embodiments.

FIG. 5 is a flowchart depicting a method 500 for adjusting the secondary path parameter based on the resonance frequency of the loudspeaker, in accordance with one or more embodiments of the present disclosure. Various steps of the disclosed method may be carried out by the adaptive filter controller 428 either alone, or in combination with other components of the ANC system 406 or processor 132.

At step 502, the ANC system 406 receives a voltage signal (V) and a current signal (I) that represent the voltage and current supplied to the loudspeaker 410. In one or more embodiments, the controller 464 of the amplifier 462 measures the voltage and current and supplies the corresponding time-dependent signals V and I to signal processing block 460.

At step 504, the ANC system 406 determines the electrical impedance of the loudspeaker 410 based on the V signal and the I signal. At step 506, the ANC system 406 determines the resonance frequency of the loudspeaker 410 based on the electrical impedance. In other embodiments, the ANC system 406 determines the resonance frequency of the loudspeaker 410 based on current, e.g., the frequency at which there is a current minimum. In other embodiments, the ANC system 406 uses predetermined data from a lookup table to determine the resonance frequency of the loudspeakers 410.

At step 508, the ANC system 406 determines the actual transfer characteristic of the secondary path $\hat{S}(z_act)$ between the loudspeaker 410 and the physical microphone 408 based on the resonance frequency ($f_{res}$) of the loudspeaker 410. Then the ANC system 406 adjusts the secondary path parameter of the secondary path filter 420 to replace the estimated transfer characteristic of the secondary path $\hat{S}(z)$ with the actual transfer characteristic of the secondary path $\hat{S}(z_act)$.

As mentioned above, the secondary path characterizes the entire signal path from the voltage supplied to the loudspeaker 410, though the airborne anti-noise transfer path to the physical microphone 408, and to the electrical signal output from the microphone e(n). The secondary path depends on the electro-mechanical properties of the loudspeaker, which in many applications, is designed to meet a resonance frequency tolerance of +/−15%. This means that the secondary path measured with an in-spec loudspeaker with a resonance frequency 15% lower than the nominal value will differ from the secondary path measured with an in-spec loudspeaker with a resonance frequency 15% higher than the nominal value. For example, a loudspeaker with nominal resonance frequency value of 60 Hz+/−15% can have a resonance frequency anywhere between 51 Hz and 69 Hz, and a loudspeaker with nominal resonance frequency value of 60 Hz+/−20% can have a resonance frequency anywhere between 48 Hz and 72 Hz.

Figure 6:
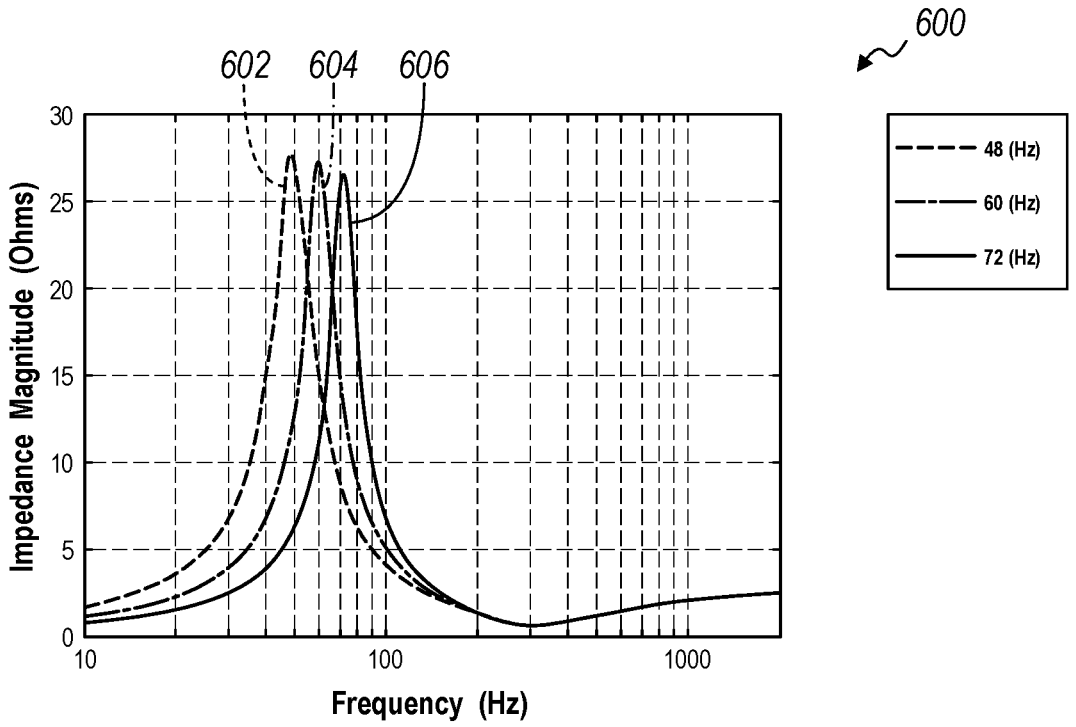
FIG. 6 is a graph illustrating the magnitude of the electrical impedance of loudspeakers with a 48 Hz, 60 Hz and 72 Hz resonance frequency.
Figure 7:
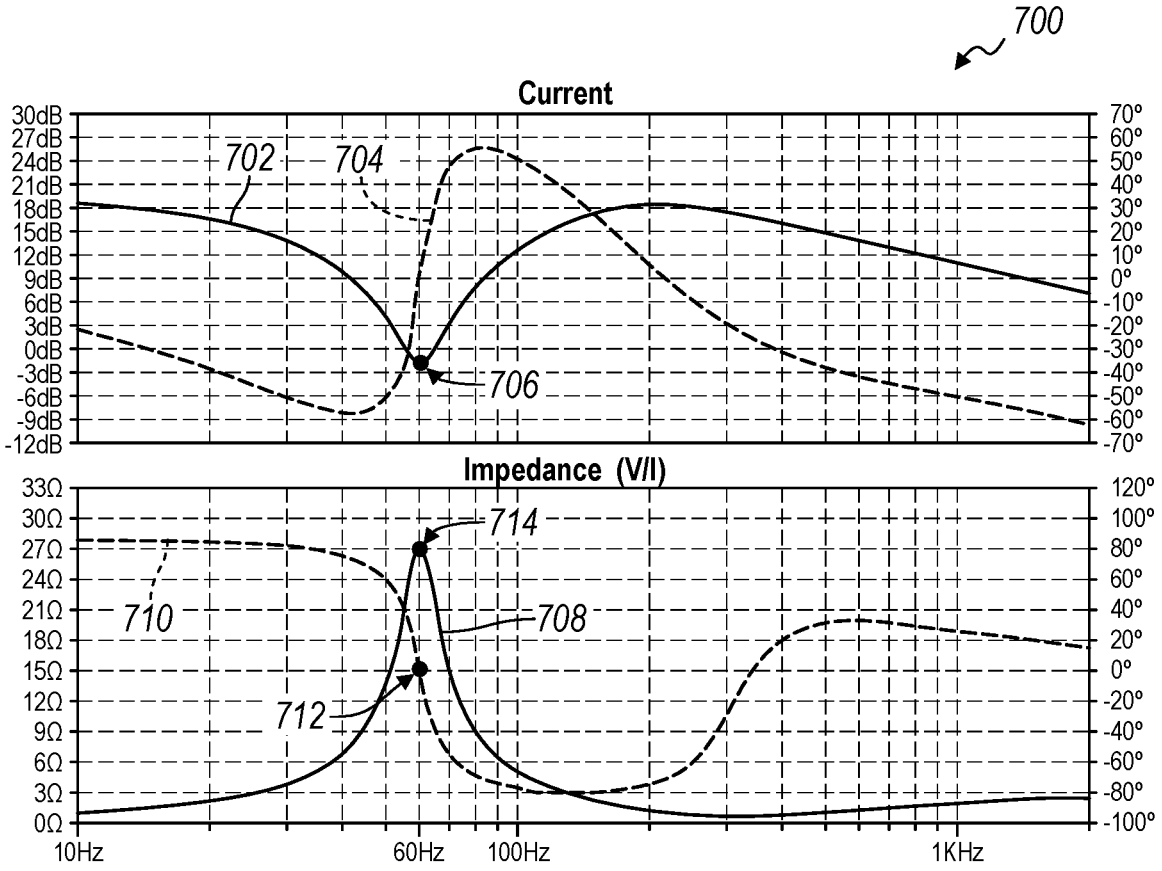
FIG. 7 is a graph illustrating the frequency dependent magnitude and phase of the electrical current and impedance as generated by the ANC system of FIG. 4 according to the method of FIG. 5.
Figure 8:
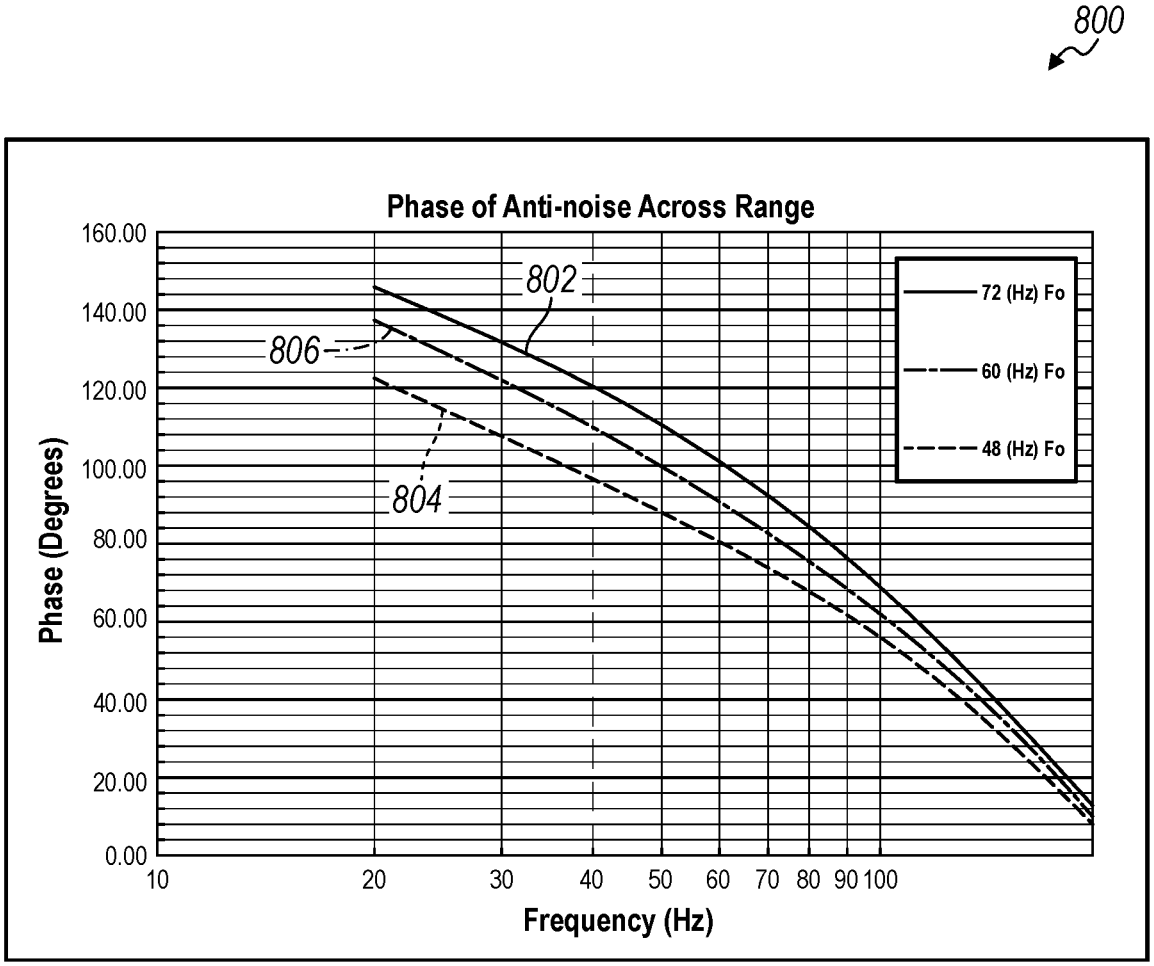
FIG. 8 is a graph further illustrating the frequency dependent phase of the anti-noise output resulting from three loudspeakers with different frequency dependent impedance curves with different resonance frequencies from FIG. 6.

FIGS. 6-8 are graphs illustrating the resonance frequencies of three loudspeakers with resonance frequencies of 48 Hz, 60 Hz, and 72 Hz. Also illustrated are several methods to detect the resonance frequency, and amount of phase change to the secondary path imparted by implementing the method 500 when the ANC system 406 adjusts a secondary path parameter, as compared to an existing ANC system that does not adjust the secondary path parameter.

FIG. 6 is a graph 600 that includes three curves 602, 604, and 606 that illustrate the magnitude of the electrical impedance of loudspeakers that meet a 60 Hz+/−20% resonance frequency. The first curve 602 illustrates the electrical impedance magnitude of a first loudspeaker with a 60 Hz-20% resonance frequency of 48 Hz, the second curve 604 illustrates the electrical impedance magnitude of a second loudspeaker with a 60 Hz resonance frequency. The third curve 606 illustrates the electrical impedance magnitude of a third loudspeaker with a 60 Hz+20% resonance frequency of 72 Hz.

FIG. 7 is a graph 700 that includes two plots and illustrates three different approaches to determine the resonance frequency of a loudspeaker. The upper plot includes two curves 702 and 704, which illustrate the magnitude and the phase of the electrical current sent to the loudspeaker, respectively, with white noise as an input signal. The resonance frequency can be identified as the frequency at which the magnitude of the current has its minimum, which is generally referenced by numeral 706, or the frequency at which the magnitude has its local minimum value in this frequency range of interest for medium or large woofers—between 20 Hz and 200 Hz. The bottom plot includes two curves 708 and 710 that illustrate the magnitude and phase of the electrical impedance, which is the ratio of voltage to current (Z=V/I). The resonance frequency can be found using a variety of methods. For example, the resonance frequency is the frequency at which the phase of the impedance equals zero degrees, as referenced by numeral 712. The resonance frequency can also be identified as the frequency at which the magnitude of the impedance has its peak value, as referenced by numeral 714. Reference numerals 706, 712, 714 illustrate three different approaches to determine that the resonance frequency of the loudspeaker is approximately 60 Hz.

FIG. 8 is a graph 800 that includes three curves 802, 804, and 806 that illustrate the phase of anti-noise generated by the ANC system for a loudspeaker at resonance frequencies of 72 Hz, 60 Hz, and 48 Hz, respectively. The curves 802 and 804 illustrate that the range of phase of acoustic output at 40 Hz (a typical SUV cabin resonance mode that is canceled by ANC systems) is approximately 25 degrees. A change in phase of 25 degrees between the stored secondary path in secondary path filter $\hat{S}(z)$ 420, and the actual secondary path S(z) will have a large impact on the convergence of the FxLMS system, in how the W-filters 426 are adapted. FxLMS systems may require a longer initial adaptation time, and may also incur stability problems if tuned with high step size when the stored and actual secondary paths are mismatched in phase. As the FxLMS system adapts the W-filters, stability problems may arise due to this mismatch, such that the W-filters do not converge to minimize the mean square error of the error signal, instead, the W-filters diverge, which will result in noise gain, instead of noise cancellation. Specifically, if a phase deviation between the ideal and current W-filters of over 60 degrees occurs, then the noise cancellation not only disappears, but noise boosting occurs. In the worst case, this noise boosting amplitude increases over time, causing divergence, and out-of-control ANC system howling, often termed feedback. Once this divergence occurs, then the system can not recover, and must be reset by its internal oversight mechanisms. Accordingly, if the individual vehicle's secondary paths differ substantially from the stored secondary path, then this type of noise boosting and divergence occurs.

Figure 9:
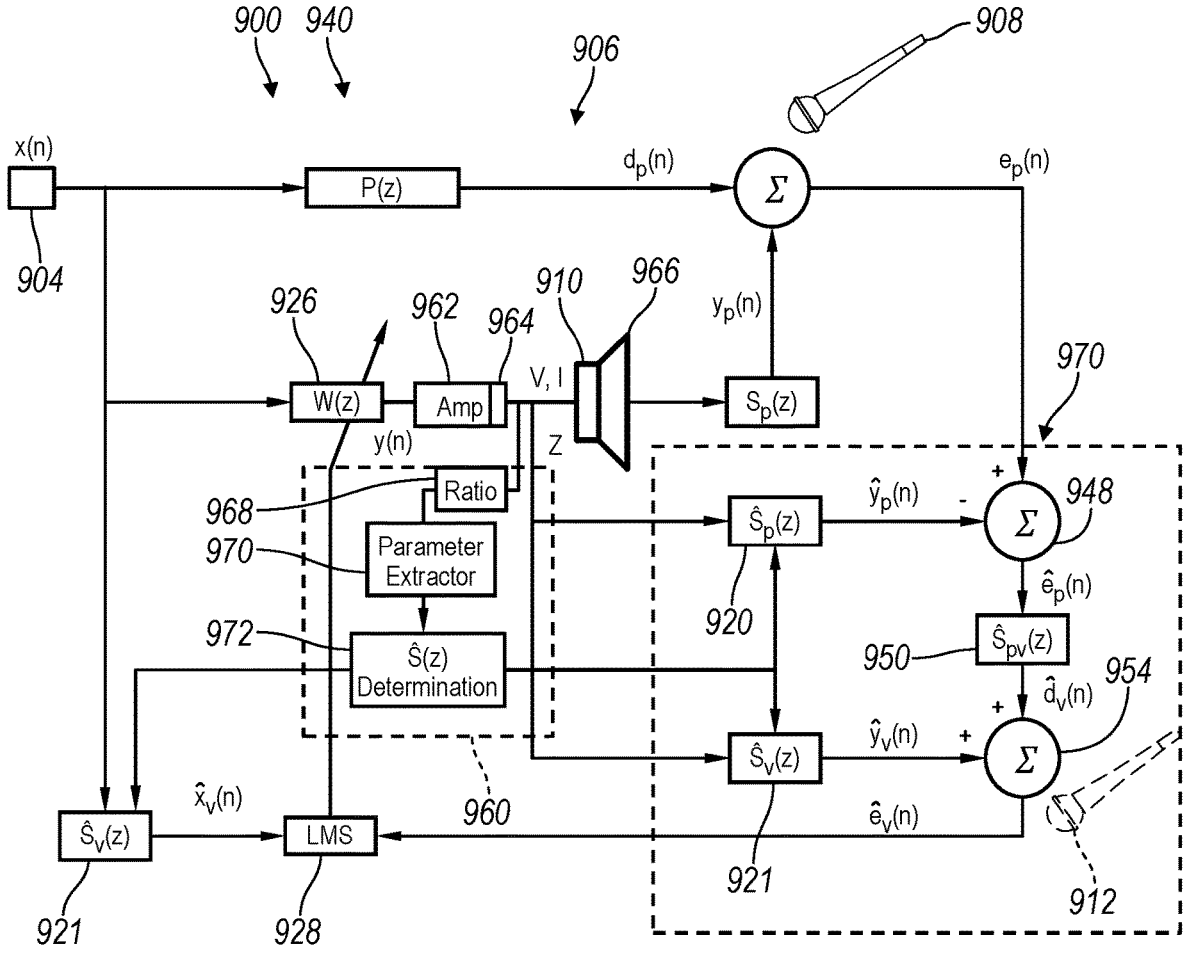
FIG. 9 is a schematic block diagram representing a remote microphone ANC system, in accordance with one or more embodiments.

FIG. 9 is a schematic block diagram of a vehicle-based remote microphone (RM) ANC system 906 showing adaptive filter controller 928 that contains many of the key ANC system parameters that may be used to adjust secondary path parameters to optimize ANC system performance. For ease of explanation, the RM ANC system 906 illustrated in FIG. 9 is shown with components and features of an RNC system 900 and an EOC system 940. Accordingly, the RM ANC system 906 is a schematic representation of an RNC and/or EOC system, such as those described in connection with FIGS. 1-4, featuring additional system components of the RM ANC system 906 including a remote microphone 912 and a remote microphone signal processing block 970. Similar components may be numbered using a similar convention.

For instance, similar to ANC system 406, the RM ANC system 906 may include a vibration sensor 904, a physical microphone 908, a loudspeaker 910, a secondary path filter 920, a w-filter 926, an adaptive filter controller 928, and an additional signal processing block 960 consistent with operation of the vibration sensor 404, the physical microphone 408, the loudspeaker 410, the secondary path filter 420, the w-filter 426, the adaptive filter controller 428, and the additional signal processing block 460, respectively, discussed above. FIG. 9 also shows the primary path P(z) and secondary path S(z), as described with respect to FIG. 4, in block form for illustrative purposes. In the case of an EOC system 940, the vibration sensor 904 is replaced by an RPM sensor 342, lookup table 346, and frequency generator 348, as described above with reference to FIG. 3.

The remote microphone 912 represents a microphone located at a remote microphone location that would similarly sense all the sound at its remote location, such as the anti-noise signal in addition to the disturbance signal $d_v(n)$ to be cancelled, which includes road noise, engine, and exhaust noise, and extraneous sounds. The pressure at the remote microphone location is estimated from the pressure at the physical microphone locations to form an estimated error signal $\hat{e}_v(n)$.

The RM ANC system 906 measures the disturbance noise to be cancelled $\hat{e}_p(n)$ at the physical microphone location at block 948. The RM ANC system 906 subtracts an estimate of the anti-noise at the physical microphone location $\hat{y}_p(n)$ that is received from the physical secondary path filter 920 from the physical error signal $e_p(n)$ to estimate the disturbance noise at the physical microphone location $\hat{e}_p(n)$. The RM ANC system 906 then estimates the disturbance noise to be cancelled at the remote microphone location $\hat{d}_v(n)$ at block 950 by convolving the estimated disturbance noise at the physical microphone location $\hat{d}_p(n)$ with the transfer function 950 between the physical and remote microphone location $\hat{S}_{pv}(z)$. At block 954, the RM ANC system 906 estimates the remote microphone error signal $\hat{e}_p(n)$ that would be present at the remote microphone location by adding an estimate of the anti-noise at this location $\hat{y}_v(n)$ that is received from a remote secondary path filter 921 from the estimated disturbance noise to be cancelled at the remote microphone location $\hat{d}_v(n)$. This remote microphone system 906 becomes a virtual microphone system if the value of $\hat{S}_{pv}(z)$ is 1, effectively bypassing the convolution of block 950.

The ANC system 906 determines the resonance frequency ($f_{res}$) of the loudspeaker 910 in signal processing block 960. The ANC system 906 includes an amplifier 962 with a controller 964 that monitors characteristics of the electrical signal supplied to the loudspeaker 910. The controller 964 may be mounted within a housing 966 of the loudspeaker 910, within the amplifier 962, or external to both the housing 966 and the amplifier 962. The controller 964 provides a voltage signal (V) and a current signal (I) based on the electrical signal sent to the loudspeaker 910.

The ANC system 906 determines an electrical impedance (Z) based on a ratio of V and I (Z=V/I) at block 968. At block 970, the ANC system 406 determines the resonance frequency ($f_{res}$) of the loudspeaker 910 based on the electrical impedance (Z), e.g., based on the frequency at which the phase of the impedance equals zero degrees, or the frequency at which the magnitude of the impedance has its peak value. In another embodiment, the ANC system 406 determines the resonance frequency based on the frequency at which the magnitude of the current has its minimum. In yet another embodiment, the ANC system 406 determines the resonance frequency based on signals representing the loudspeaker position, velocity, acceleration, and/or internal box pressure using the lumped element Thiele-Small loudspeaker theory.

At block 972, the ANC system 906 determines the actual transfer characteristic of the physical secondary path 920 $\hat{S}$(pz_act) and the remote secondary path 921 $\hat{S}$(vz_act) based on the resonance frequency ($f_{res}$) of the loudspeaker 910. Then the ANC system 906 adjusts a secondary path parameter of the secondary path filters 920, 921 to replace the estimated transfer characteristic of the physical and remote secondary path $\hat{S}_p(z)$ and $\hat{S}_v(z)$ with the actual transfer characteristic of the secondary path $\hat{S}_p$(z_act) and $\hat{S}_v$(z_act), respectfully. Then the adaptive filter controller 928 controls the w-filter 926 adaptation based on the adjusted secondary path parameters. The secondary path filters 920 or 921 may be implemented in the time domain or in the frequency domain, according to one or more embodiments.

Although the ANC system is described with reference to a vehicle, the techniques described herein are applicable to non-vehicle applications. For example, a room may have fixed seats which define a listening position at which to quiet a disturbing sound using reference sensors, error sensors, loudspeakers and an FxLMS adaptive system. Note that the disturbance noise to be cancelled is likely of a different type, such as HVAC noise, or noise from adjacent rooms or spaces. Further, a room may have occupants whose position varies with time, and the seat sensors or head tracking techniques described herein must then be relied upon to determine the position of the listener or listeners so that the 3-dimensional location of the remote microphones can be selected.

As described above, it is desirable to account for shifts relative to "golden sample" nominal secondary path values in production noise cancellation systems, and there are several methods or embodiments to achieve this. In one embodiment, the ANC system recalls the secondary path for each loudspeaker's particular resonance frequency, i.e., if the amplifier controller measures a woofer to have a resonance frequency of 70 Hz, then the secondary path that was measured with a 70 Hz loudspeaker is recalled from memory. There is a secondary path from each loudspeaker 910 to each physical microphone 908 or remote microphone 912 location. So, in a system with multiple microphones the ANC system will recall the set of secondary paths for a 70 Hz loudspeaker to each of the microphones in the system. This would require that the tuning engineers measure secondary paths with a suite of loudspeakers covering the range of in-spec resonance frequencies, which would add memory to the algorithm. An alternative is to use computational modeling (e.g., simple lumped element modeling of the loudspeaker in its housing) to compute the magnitude and phase difference in loudspeaker response as a function of loudspeaker resonance frequencies. This set of magnitude and phase differences (e.g. the data in FIG. 6 and FIG. 8) could then be stored in memory, and used to post process the set of "nominal golden" secondary paths into the various $\hat{S}_p$(z_act) and $\hat{S}_v$(z_act) for use in the ANC system.

In another embodiment, the ANC system measures the difference between a secondary path measured with a "nominal golden" loudspeaker and a suite of other loudspeakers with in-spec resonance frequencies, and stores these differences, to be recalled at run time.

In yet another embodiment, a simple lumped element model of the loudspeaker, or the loudspeaker and its housing, can be stored in the amplifier controller, and can be used to process the one stored "nominal golden" secondary path that is stored in the amplifier. Similarly, this nominal secondary path with loudspeaker model can be stored for each loudspeaker in the system. Computation of the appropriate secondary path can then be done dynamically, while the vehicle is in operation. This is possible to do without pops and clicks, because the stored secondary path is used only in the update path, and not in the anti-noise creation path in the FxLMS system, so changing the secondary path can be done without audible artifacts (pops or clicks) being generated. A suite of combinations of these techniques is also possible.

Although FIGS. 1, 3, 4, and 9 show LMS-based adaptive filter controllers 128, 328, 428, and 928, respectively, other methods and devices to adapt or create optimal controllable W-filters 126, 326, 426, and 926 are possible. For example, in one or more embodiments, neural networks may be employed to create and optimize W-filters in place of the LMS adaptive filter controllers. In other embodiments, machine learning or artificial intelligence may be used to create optimal W-filters in place of the LMS adaptive filter controllers.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Further, functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

While exemplary embodiments are described above, it is not intended that these embodiments describe all possible forms of the present disclosure. Rather, the words used in the specification are words of description rather than limitation, and it is understood that various changes may be made without departing from the spirit and scope of the present disclosure. Additionally, the features of various implementing embodiments may be combined to form further embodiments.

What is claimed is:

1. An active noise cancellation (ANC) system comprising:

at least one loudspeaker to project an anti-noise sound within a room in response to receiving an anti-noise signal; and a first controller programmed to:

adjust a transfer function indicative of a secondary path between the at least one loudspeaker and at least one microphone within the room based on a resonance frequency of the at least one loudspeaker, and generate the anti-noise signal based on the adjusted transfer function.

2. The ANC system of claim 1 further comprising:

a second controller in communication with the first controller and programmed to measure characteristics of an electrical signal supplied to the at least one loudspeaker; and wherein the characteristics of the electrical signal are indicative of at least one of a voltage and a current supplied to the at least one loudspeaker.

3. The ANC system of claim 2, wherein the first controller is further programmed to determine the resonance frequency of the at least one loudspeaker based on an impedance of the at least one loudspeaker.

4. The ANC system of claim 3, wherein the first controller is further programmed to determine the resonance frequency of the at least one loudspeaker based on a frequency at which a phase of the impedance equals zero degrees.

5. The ANC system of claim 3, wherein the first controller is further programmed to determine the resonance frequency of the at least one loudspeaker based on a peak value of a magnitude of the impedance.

6. The ANC system of claim 1, wherein the first controller is further programmed to determine the resonance frequency of the at least one loudspeaker based on a minimum value of a magnitude of a current supplied to the at least one loudspeaker.

7. The ANC system of claim 1 further comprising the at least one microphone, wherein the at least one microphone is configured to provide an error signal indicative of noise and the anti-noise sound within the room.

8. The ANC system of claim 7, wherein the first controller is further programmed to:

filter the error signal using the adjusted transfer function to obtain an estimated error signal; and generate the anti-noise signal based on the estimated error signal.

9. The ANC system of claim 1, wherein the first controller is further programmed to:

adjust a first transfer function indicative of a first secondary path between the at least one loudspeaker and a first microphone within the room based on the resonance frequency; and adjust a second transfer function indicative of a second secondary path between the at least one loudspeaker and a remote microphone location within the room based on the resonance frequency, wherein the first microphone and the remote microphone location are located at different locations within the room.

10. The ANC system of claim 9, wherein the first controller is further programmed to generate a first anti-noise signal based on the first adjusted transfer function and generate a second anti-noise signal based on the second adjusted transfer function.

11. The ANC system of claim 1, wherein the room comprises a passenger cabin, the ANC system further comprising:

the at least one microphone, wherein the at least one microphone is configured to provide an error signal indicative of noise and the anti-noise sound within the passenger cabin;

a sensor to measure a voltage and a current supplied to the loudspeaker; and wherein the first controller is further programmed to determine the resonance frequency of the loudspeaker based on the voltage and current supplied to the loudspeaker.

12. The ANC system of claim 11, wherein the at least one controller is further programmed to:

determine an impedance of the loudspeaker based on the voltage and current supplied to the loudspeaker; and determine the resonance frequency of the loudspeaker based on at least one of a peak value of a magnitude of the impedance, and a frequency at which a phase of the impedance equals zero degrees.

13. The ANC system of claim 11, wherein the at least one controller is further programmed to determine the resonance frequency of the loudspeaker based on a minimum value of a magnitude of the current supplied to the loudspeaker.

14. The ANC system of claim 11, wherein the at least one controller is further programmed to:

adjust a first transfer function indicative of a first secondary path between the loudspeaker and a first microphone within the passenger cabin based on the resonance frequency; and adjust a second transfer function indicative of a second secondary path between the loudspeaker and a remote microphone location within the passenger cabin based on the resonance frequency, wherein the first microphone and the remote microphone location are located at different locations within the passenger cabin.

15. The ANC system of claim 14, wherein the at least one controller is further programmed to generate a first anti-noise signal based on the first adjusted transfer function and generate a second anti-noise signal based on the second adjusted transfer function.

16. A method for controlling stability in an active noise cancellation (ANC) system, the method comprising:

adjusting a transfer function indicative of a secondary path between a loudspeaker and a microphone within a passenger cabin based on a resonance frequency of the loudspeaker; and generating an anti-noise signal, to be radiated from the loudspeaker within the passenger cabin as an anti-noise sound, based on the adjusted transfer function.

17. The method of claim 16 further comprising:

determining the resonance frequency of the loudspeaker based on at least one of a peak value of a magnitude of an impedance of the loudspeaker, and a frequency at which a phase of the impedance equals zero degrees.

18. The method of claim 16 further comprising determining the resonance frequency of the loudspeaker based on a minimum value of a magnitude of a current supplied to the loudspeaker.

19. The method of claim 16 further comprising:

adjusting a first transfer function indicative of a first secondary path between the loudspeaker and a first microphone within the passenger cabin based on the resonance frequency; and adjusting a second transfer function indicative of a second secondary path between the loudspeaker and a remote microphone location within the passenger cabin based on the resonance frequency, wherein the first microphone and the remote microphone location are located at different locations within the passenger cabin.

20. The method of claim 19 further comprising generating a first anti-noise signal based on the first adjusted transfer function and generating a second anti-noise signal based on the second adjusted transfer function.

* * * * *